US006317895B1

(12) United States Patent
Erth et al.

(10) Patent No.: US 6,317,895 B1
(45) Date of Patent: Nov. 20, 2001

(54) SAFETY HELMET ASSEMBLY

(75) Inventors: Richard A. Erth, Wexford; Layton A. Wise, Washington, both of PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 09/353,504

(22) Filed: Jul. 14, 1999

Related U.S. Application Data

(60) Provisional application No. 60/121,911, filed on Feb. 26, 1999.

(51) Int. Cl.[7] ..... A42B 3/00

(52) U.S. Cl. ..... 2/411; 2/412; 2/416

(58) Field of Search ..... 2/410, 411, 412, 2/414, 416, 2.5, 5, 6.6, 6.8

(56) References Cited

U.S. PATENT DOCUMENTS

| | | | | |
|---|---|---|---|---|
| 3,616,463 | * | 11/1971 | Theodore et al. | 2/412 |
| 3,946,441 | * | 3/1976 | Johnson | 2/410 |
| 4,656,667 | * | 4/1987 | Blake | 2/5 |
| 5,517,691 | * | 5/1996 | Blake | 2/5 |
| 5,669,079 | * | 9/1997 | Morgan | 2/414 |
| 5,898,949 | * | 5/1999 | Barthold et al. | 2/416 |
| 5,956,777 | * | 9/1999 | Popovich | 2/424 |
| 6,032,297 | * | 3/2000 | Barthold et al. | 2/416 |

* cited by examiner

*Primary Examiner*—Michael A. Neas
(74) *Attorney, Agent, or Firm*—James G. Ulber; Henry E. Bartony, Jr.

(57) ABSTRACT

A safety helmet having a rigid outer shell, a shock absorbing layer inside of the outer shell, and a shield layer fabricated from a strong and lightweight material positioned between the outer shell and the shock absorbing layer. The shield layer is preferably free to move relative to the outer shell in a direction toward the shock absorbing layer.

18 Claims, 2 Drawing Sheets

SAFETY HELMET ASSEMBLY

This application claims the benefit of prior provisional application No. 60/121,911 filed Feb. 26, 1999.

FIELD OF THE INVENTION

The present invention relates to safety helmets, and particularly, to safety helmet assemblies providing protection against top impacts, lateral impacts and penetrating impacts.

BACKGROUND OF THE INVENTION

Many types of protective headgear or safety helmets are worn by individuals to protect against head injuries. For example, safety helmets providing protection from top impacts, lateral impacts and/or penetrating impacts typically include a rigid outer shell, a shock absorbing layer within the outer shell and a suspension system. An example of such a safety helmet is the SUPER V safety helmet available from Mine Safety Appliances Company of Pittsburgh, Pennsylvania. In such safety helmets, the outer shell, the shock absorbing layer, along with the suspension act to absorb the shock of any impact to the safety helmet.

Safety helmets providing protection from top impacts, lateral impacts and penetrating impacts are subjected to stringent testing requirements. Those safety helmets are tested under Impact Standard ANSI Z89.1-1997 in the United States and under CSA Z94.1-1992 in Canada. Under CSA Z94.1-1992, for example, safety helmets are subjected to a rigorous penetration test in which a heavily weighted, pointed projectile is accelerated to impact the helmet. To satisfy such penetration tests, manufacturers of safety helmets fabricate the outer shell of the safety helmet from a relatively thick layer of a high impact strength material. The thicker the layer, the heavier the helmet, which makes the helmet uncomfortable for the user to wear. This discomfort can result in fatigue and/or a reluctance to use the safety helmet, either of which can result in safety lapses. Furthermore, use of a relatively thick layer of a very high impact strength material results in substantial manufacturing expense.

It is very desirable, therefore, to develop a safety helmet that provides top impact protection, side impact protection and penetration protection that is lightweight and comfortable to wear, as well low cost and simple to manufacture.

SUMMARY OF THE INVENTION

Generally, the present invention provides a safety helmet assembly comprising:

(a) a rigid outer shell;

(b) a shock absorbing layer inside of the outer shell; and (c) a shield layer positioned between the outer shell and the shock absorbing layer.

The shield layer assists in preventing an object that penetrates the outer shell from contacting the user's head. The shield layer is thus preferably fabricated from a relatively strong material that is also lightweight and inexpensive. In that regard, the shield layer is preferably fabricated from a polymeric material having a notched impact strength greater than 0.5 ft.lb./in. The polymeric material also preferably has a modulus in the range of approximately 150,000 to approximately 700,000 psi. Polymeric materials used in the present invention, when amorphous, preferably have a glass transition temperature ($T_g$) of at least approximately 125° C. Semicrystalline or crystalline polymeric materials preferably have a crystalline melting point of at least approximately 95° C.

To minimize the size, weight and cost of the safety helmet assembly, the thickness of the shield layer is preferably minimized, particularly when using polymeric materials as described above. The thickness of the shield layer is preferably in the range of approximately 0.015 to approximately 0.040 in. More preferably, the thickness of the shield layer is preferably in the range of approximately 0.025 to approximately 0.035 in. In general, the stronger/more impact resistant the material used in fabricating the shield layer, the thinner the shield layer can be. Regardless of modulus, impact strength and thickness, an appropriate material for the shield layer and the thickness thereof is readily and easily determined using a known standard such as provided in CSA Z94.1-1992.

Similarly, the cost and manufacturability of the material are preferably taken into account since there are many strong, lightweight materials which are simply too expensive for use in a helmet or cannot be manufactured easily in a helmet.

Preferably, the shield layer is free to move relative to the outer shell in a direction toward the shock absorbing layer. It is believed that forcing the shield layer into the shock absorbing layer upon penetration of the outer shell absorbs some of the energy of the penetrating object and limits the extent of penetration.

The present inventors have discovered that placement of a relatively thin shield layer between the outer shell and shock absorbing layer of a safety helmet assembly greatly increases the penetration resistance of the safety helmet assembly. The incorporation of such a shield layer eliminates the need to fabricate the outer shell of the helmet from a thick layer of a relatively high strength material. The weight, size and cost of safety helmet assemblies can be reduced with the use of the shield layer of the present invention.

DETAILED DESCRIPTION OF THE INVENTION

Figure 1:
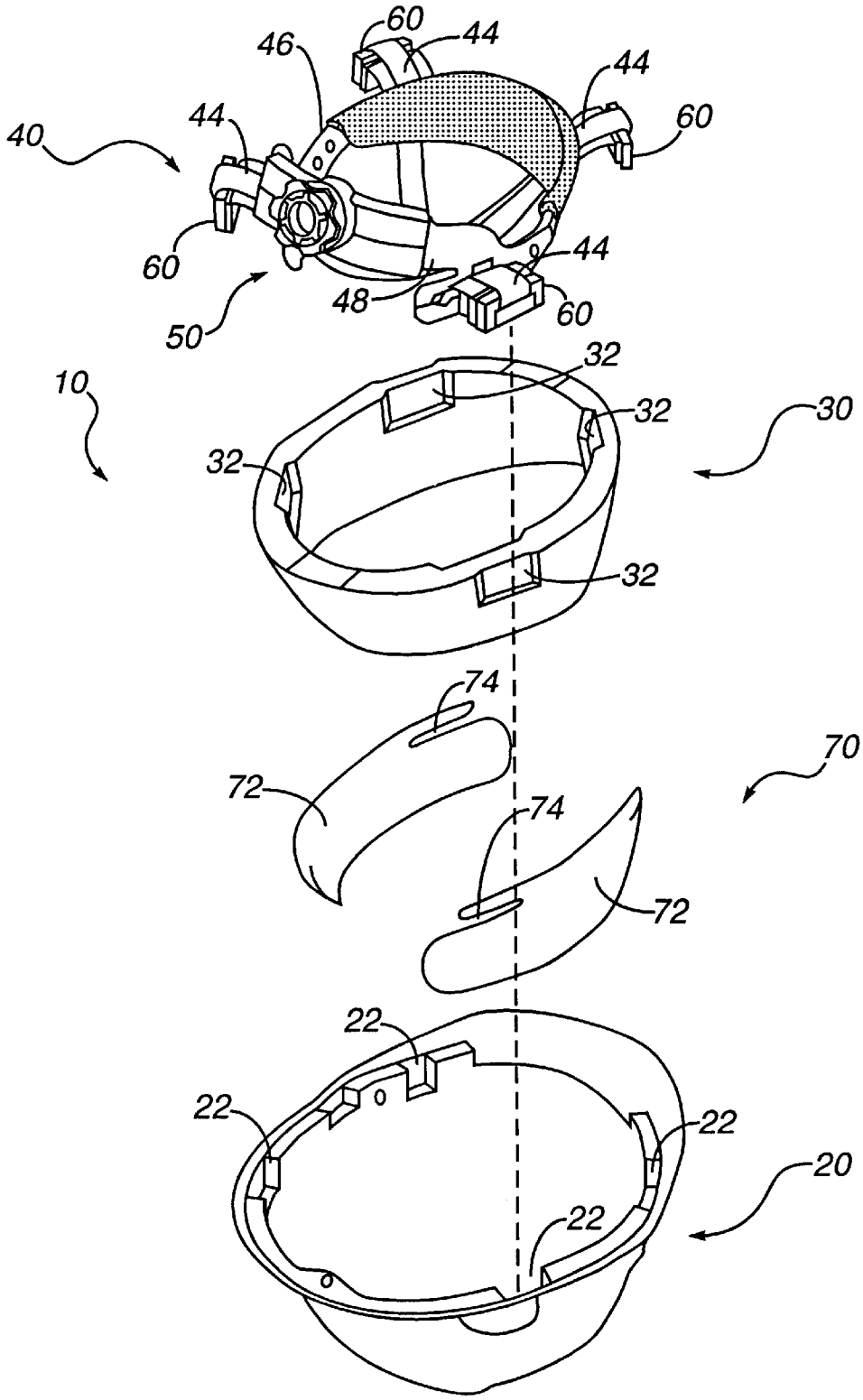
FIG. 1 illustrates a perspective view of an embodiment of a safety helmet assembly of the present invention in an unassembled state.

As illustrated in FIG. 1, safety helmet assembly 10 of the present invention preferably includes a rigid outer shell 20 fabricated from a relatively rigid, strong material. Safety helmet assembly 10 also preferably includes a shock absorbing layer 30 formed generally to the shape of the interior of outer shell 20. Shock absorbing layer 30 is preferably fabricated from a collapsible material such as a foamed polymeric material suitable to absorb the shock of a lateral or side impact upon outer shell 20. Since shock absorbing layer 30 protects predominantly against side impacts, shock absorbing layer 30 typically need not extend to the top of outer shell 20 when safety helmet assembly 10 is assembled.

Safety helmet assembly 10 also preferably comprises a suspension 40 as disclosed, for example, in U.S. patent application Ser. No. 08/838,004, filed Apr. 4, 1997, now U.S. Pat. No. 5,950, 245, the disclosure of which is incorporated herein by reference. In that regard, suspension 40 may include strips 44 of, for example, webbing material arranged to cross each other. The ends of webbing strips 44 are preferably attached at four or more points around the circumference of the outer shell 20. Webbing strips 44 form the crown portion of suspension 44. A headband 46 is then typically attached at four or more points to suspension 40 to permit safety helmet assembly 10 to be worn by the worker. To securely position safety helmet assembly 10 on the worker's head, it is preferable that the circumference of headband 46 be adjustable to fit the appropriate head size. In that regard, an adjustable napestrap 48 may be attached at a rearward end of headband 46 to achieve these results. In the embodiment of FIG. 1, a ratchet mechanism 50 adjusts the fit of suspension 40.

As illustrated in FIG. 1, the ends of webbing strips 44 are preferably attached to tabs 60 that preferably pass through passages 32 in shock absorbing layer 30 to be removably seated in cooperating ports 22 formed around the circumference of outer shell 20.

Unlike prior safety helmet assemblies, safety helmet assembly 10 further includes a shield layer 70 preferably comprising one or more sections 72 formed from a relatively structurally strong polymeric material such as nylon or polycarbonate. Shield sections 72 are preferably positioned between outer shell 20 and shock absorbing layer 30. Shield sections 72 are also preferably relatively thin to prevent a substantial increase in the overall size and weight of safety helmet assembly 10. In one embodiment, outer shell 20 was fabricated from polyethylene and shield sections 72 were fabricated from nylon of a thickness of approximately 0.030 in.

Likewise, shield sections 72 are also preferably limited in size (area) and positioned adjacent to only those sections of outer shell 20 and shock absorbing layer 30 requiring reinforcement for protection against puncturing impacts. In that regard, certain regions of outer shell 20 may be less resistant to penetration than other regions or the distance between the outer shell and the head of the user may be less than in other regions. The curvature of outer shell 20 at the forward and rearward ends thereof and the distance from outer shell 20 to the head of the user at the top portion of outer shell 20 make contact of a penetrating object with the head of the user less likely in those regions. On the other hand, the reduced amount of curvature on the sides of outer shell 20 may result in less resistance to penetration. Likewise, it is in the area of the lower sides of outer shell 20 that the user's head is closest to outer shell 20. Furthermore, in the embodiment of FIG. 1, passages 32 in shock absorbing layer 30 may increase the likelihood that a penetrating object may contact the user's head in the vicinity thereof. Shield sections 72 are thus preferably positioned on each side of safety helmet assembly 10 and cover passages 32.

Figure 2:
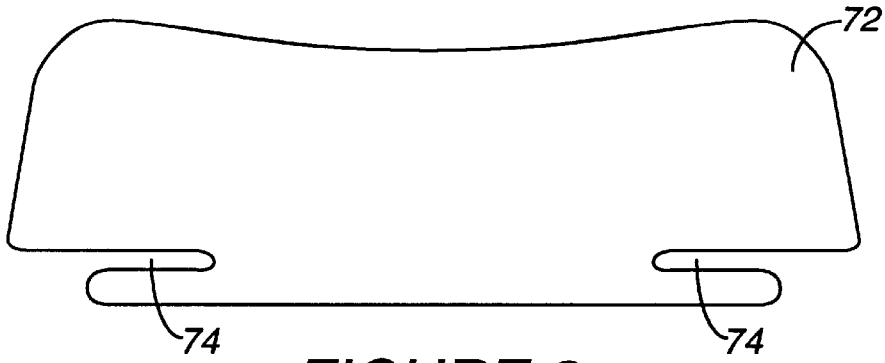
FIG. 2 illustrates an expanded side view of an embodiment of a shield layer section of the present invention.
Figure 3A:
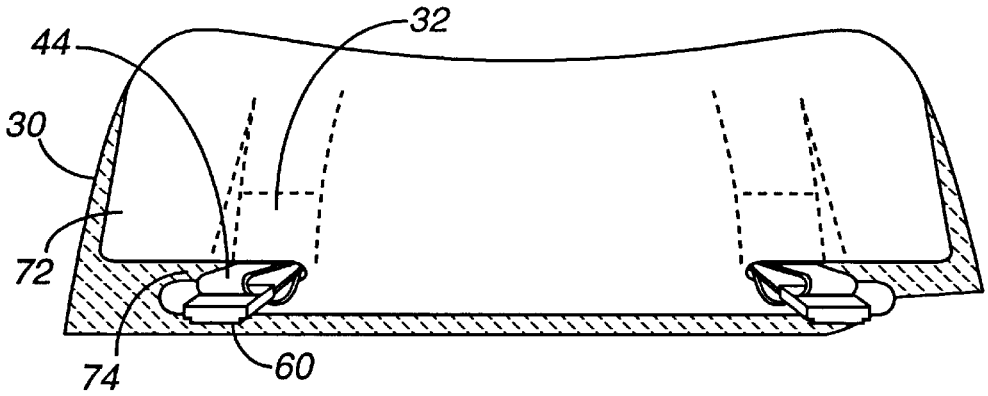
FIG. 3A and 3B illustrate expanded side views of the shield layer section of FIG. 2 as positioned within the safety helmet assembly of FIG. 1.
Figure 3B:
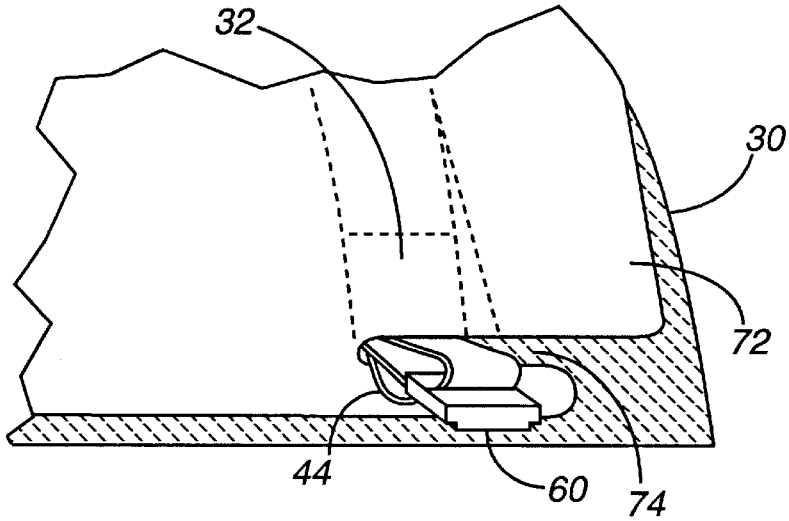

As best illustrated in FIGS. 2, 3A and 3B, shield sections 72 may be provided with slots 74 at each end thereof through which webbing strips 44 may pass when shield sections 72 are positioned within safety helmet assembly 10. Shield sections 72 are thereby held securely within safety helmet assembly 10 but are allowed to float or move relatively freely (that is, in a generally radial direction relative to the circumference of outer shell 20) between outer shell 20 and shock absorbing layer 30. Shield sections 72 preferably are not attached to outer shell 20 so that in the case of a penetration of outer shell 20, the penetrating object will contact one of shield sections 72 and displace shield section 72 in the direction of shock absorbing layer 30. Shield section 72 will be forced into shock absorbing layer 30 which will compress to absorb some of the energy of the penetrating object.

Although the present invention has been described in detail in connection with the above embodiments, it is to be understood that such detail is solely for that purpose and that variations can be made by those skilled in the art without departing from the spirit of the invention except as it may be limited by the following claims.

What is claimed is:

1. A safety helmet assembly comprising:

(a) a rigid outer shell;

(b) an unsegmented shock absorbing layer inside of the outer shell (c) a nonflaccid shield layer comprising a plurality of individual sections positioned between the outer shell and the shock absorbing layer, the shield layer being fabricated from a polymeric material having a modulus in the range of approximately 150,000 to approximately 700,000 psi.

2. The safety helmet assembly of claim 1 wherein the shield layer is free to move relative to the outer shell in a direction toward the shock absorbing layer.

3. The safety helmet assembly of claim 1 wherein the thickness of the shield layer is in the range of approximately 0.015 to approximately 0.040 mil.

4. The safety helmet assembly of claim 3 wherein the thickness of the shield layer is in the range of approximately 0.025 to approximately 0.035 mil.

5. The safety helmet assembly of claim 1 wherein the polymeric material has a notched impact strength greater than approximately 0.5 ft. lb./in.

6. The safety helmet assembly of claim 1 shield layer is fabricated from nylon.

7. The safety helmet assembly of claim 1 wherein the outer shell layer is fabricated from polyethylene.

8. The safety helmet assembly of claim 1 wherein the outer shell is fabricated from polyethylene and the shield layer is fabricated from nylon.

9. A safety helmet assembly comprising:

(a) a suspension connected to a rigid outer shell;

(b) a shock absorbing layer inside of the outer shell; and (c) a nonflaccid shield layer positioned between the outer shell and the shock absorbing layer, the shield layer comprises a plurality of individual sections with a first section positioned on a first side of the safety helmet assembly and a second section positioned on a second side of the safety helmet assembly.

10. The safety helmet assembly of claim 9 wherein the first and second sections are opposite each other.

11. The safety helmet assembly of claim 9 wherein the suspension comprises straps connected at the ends thereof to the outer shell, each of the first section and the second section comprising a slot on each lateral end thereof, each of the slots cooperating with one of the straps to removably connect the first section and the second section to the safety helmet assembly.

12. The safety helmet assembly of claim 11 wherein the shield layer is fabricated from a polymeric material having a modulus in the range of approximately 150,000 to approximately to 700,000 psi.

13. The safety helmet assembly of claim 11 wherein the thickness of the shield layer is in the range of approximately 0.015 to approximately 0.040 mil.

14. The safety helmet assembly of claim 11 wherein the thickness of the shield layer is in the range of approximately 0.025 to approximately 0.035 mil.

15. The safety helmet assembly of claim 11 wherein the polymeric material has a notched impact strength greater than approximately 0.5 ft.lb./in.

16. The safety helmet assembly of claim 11 wherein the shield layer is fabricated from nylon and the outer shell is fabricated from polyethylene.

17. A safety helmet assembly comprising:

(a) a suspension connected to a rigid outer shell;

(b) a shock absorbing layer inside of the outer shell; and (c) a nonflaccid shield layer having a thickness in the range of approximately 0.015 to approximately 0.040 mil, positioned between the outer shell and the shock absorbing layer, the shield layer comprising a first section positioned on a first side of the safety helmet assembly and a second section positioned on a second side of the safety helmet assembly, the first and second sections being opposite each other.

18. The safety helmet assembly of claim 17 wherein the shield layer is fabricated from nylon and the outer shell is fabricated from polyethylene.

* * * * *